United States Patent [19]

Asano

[11] Patent Number: 4,626,667

[45] Date of Patent: Dec. 2, 1986

[54] RADIANT HEATER OF SHORT RESPONSE TIME

[75] Inventor: Kazuo Asano, Nagoya, Japan

[73] Assignee: Kabushiki Kaisha Asano Kenkyusho, Nagoya, Japan

[21] Appl. No.: 827,032

[22] Filed: Feb. 5, 1986

[30] Foreign Application Priority Data

Mar. 29, 1985 [JP] Japan ..... 50-47519[U]

[51] Int. Cl.[4] ..... H05B 3/06; H01C 3/10

[52] U.S. Cl. ..... 219/542; 219/353; 219/460; 219/467; 338/284; 338/293

[58] Field of Search ..... 219/345, 353–357, 219/464, 459, 460, 467, 542; 338/283–293

[56] References Cited

U.S. PATENT DOCUMENTS 3,043,942 7/1962 Wickwire, III et al. ..... 219/550 X 4,100,395 7/1978 Baccard ..... 219/356

FOREIGN PATENT DOCUMENTS 540069 4/1957 Canada ..... 338/287

*Primary Examiner*—E. A. Goldberg

*Assistant Examiner*—Gerald E. Preston

*Attorney, Agent, or Firm*—Sughrue, Mion, Zinn, Macpeak & Seas

[57] ABSTRACT

Plastic web to be fed into opposite dies for forming articles must be heated and softened by heater means in front of the forming machine, even if said machine is combined with an extruder supplying said plastic web. The invention provides a radiant heater adapted to be sensitively responsive to manual or automatic control so as to more suitably regulate a temperature of the plastic web in comparison with the conventional heater comprising quartz tubes each having a coiled nichrome wire. The heater of the invention comprises an extended thin nichrome plate arranged in zig-zag on a table plate.

4 Claims, 5 Drawing Figures

RADIANT HEATER OF SHORT RESPONSE TIME

FIELD OF THE INVENTION AND RELATED ART

The present invention relates to a radiant heater to be preferably used for heating plastic web to be fed to a molding machine.

There are various formed articles such as buckets and various vessels, cabinets for the electric or electronic appliances, inner boxes of the refrigerator and the like which are formed by feeding a plastic web previously suitably heated and softened between separated male and female dies which are then moved to engage with each other for molding.

The temperature, at which the web is to be heated, is very important in order to attain satisfactory molding and varied depending on kind of the used termoplastic material such as polyvinyl chloride, polystyrene, and acrylonitrile/butadiene/styrene copolymer. Said temperature for instance of high impact polystyrene is about 140° C.

Typical heating device for the forming machine comprises a plurality of quartz tubes arranged side by side so as to heat the web as uniformly as possible. Each tube contains therein a coiled wire of electrically high resistant material which must be hard to be oxidized, such as nickel alloy added with about 20% chromium which is usually called nichrome. Such heating device is usually arranged above the plastic web to be supplied to the molding machine, and as occasion demands further another heating device is arranged below said plastic web.

In order to carry out efficient forming, the plastic web must be heated as fast as possible, and at the same time it must be avoided that the plastic sheet is excessively heated in order to attain satisfactory molding. Thus, heat generation of the heater is to be controlled by energization and deenergization of the heater, or by adjustment of voltage or current of electric energy supplied thereto, or by employing the above two methods in combination, manually or according to a programmable controller with detecting the temperature of the plastic web.

Such control is, however, not always easy as well known by those skilled in the art. Even if deenergization of the heater or decrease of electric energy thereto is made well before the temperature of the plastic sheet reaches at the desired temperature, it often becomes too high as explained later in more detail. In other words the conventionally used heater is too slow in response to said control.

SUMMARY OF THE INVENTION

An object of the invention is, thus, to provide a radiant heater of a short response time so as to be preferably used for heating plastic web to be fed to a moldingly forming machine.

Another object is to provide such heater of simple construction and to be readily assembled.

Such objects may be attained according to the invention, which will be appreciated for those skilled in the art when studying the explanation on a preferred example to be made hereafter in reference to the accompanying drawing, by providing a radiant heater comprising a table plate; an electrically insulating plate extendedly over the surface of one side of said table plate; a plurality of elongated thin plates made of a material generating Joule's heat, each of which is longitudinally bent so that the transverse section thereof is substantially V-shaped and longitudinally extended above said insulating plate, being transversely arranged with leaving a space between every adjacent two, which are electrically connected by a transversely extending thin plate of the same material at the free ends thereof so as to form a heater element extended in zig-zag; and a plurality of cup insulators, each of which has a body portion, a leg portion protruded so as to pass through said insulating plate and table plate to be fixed thereto and a head portion forming an annular groove between the same and said body portion, being transversely arranged in two rows with leaving such a space between every adjacent two that said longitudinally extended thin plate may be held at the side edges thereof with said annular groove of each of the adjacent cup insulators respectively of the two rows.

DETAILED EXPLANATION OF PREFERRED EMBODIMENT

Figure 1:
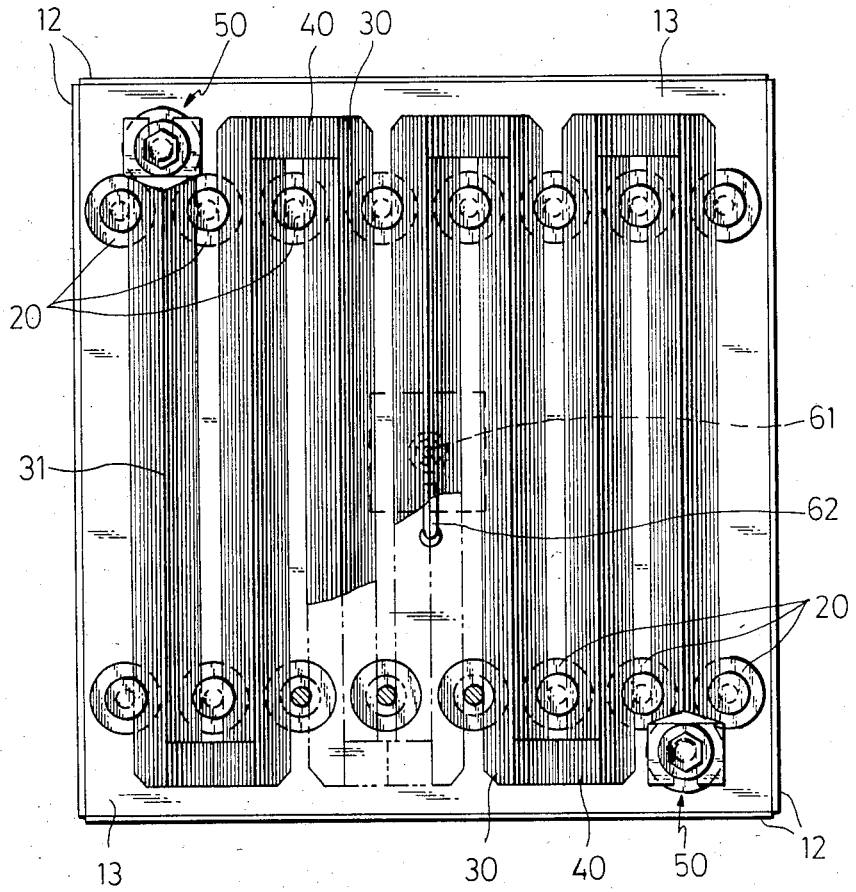
FIG. 1 is a plan view of a preferred embodiment of the invention partly cut off.
Figure 2:
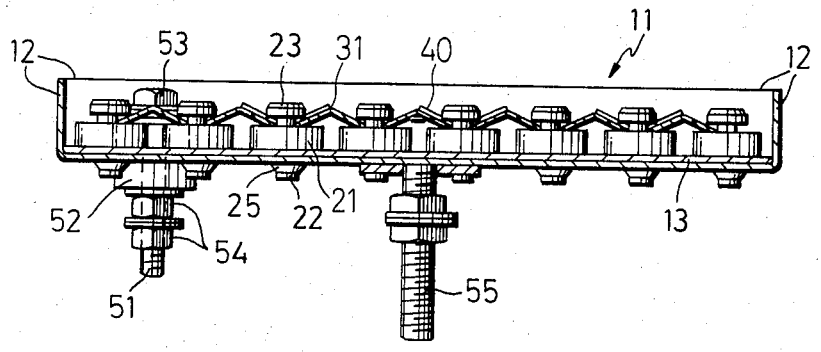
FIG. 2 is a section taken along a line II—II in FIG. 1.
Figure 3:
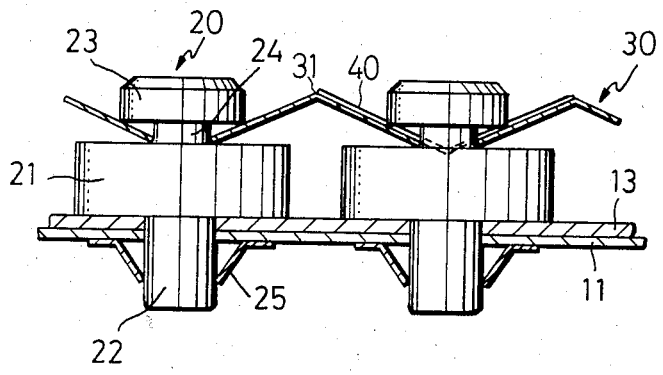
FIG. 3 is a similar but fragmentary view in a larger scale.

In FIGS. 1-3, the radiant heater according to the invention comprising a table plate 11 having four side walls 12 like as a rectangular pan and an insulating plate 13 made of mica and extended over the bottom wall of said pan-like table plate 11.

A cup insulator made of sintered alumina represented generally by 20 has a body portion 21, a leg portion 22 downwardly protruded therefrom and a head portion 23. Between said head portion 23 and said body portion 21, there is formed a neck or an annular groove 24, as best shown in FIG. 3. Said cup insulator 20 is mounted on the insulating plate 13 by penetrating the leg 22 through a hole formed in said plate 13 and the table plate 11 and by fixing said leg 22 to said plate 11 with a snap ring 25.

As best shown in FIG. 1, a plurality of cup insulators 20 (eight ones in this embodiment) are transversely arranged with leaving a space between every adjacent insulators in two rows (totally sixteen insulators).

An elongated thin plate represented generally by 30 and made of nichrome is longitudinally bent 31 so that the transverse section thereof is V-shaped as best shown in FIGS. 2 and 3. A plurality of such elongated thin plate 30 (seven ones in this embodiment) are transversely arranged side by side with leaving a space between every adjacent two, which are electrically connected at the ends by nichrome thin plate 40 so as to form a heater element extending in zig-zag from the left-top corner to the right-bottom corner of the table plate and consequently of the insulating plate in FIG. 1. Said heater element is preferably coated with black paint of a good infrared radiation property. Said connecting thin plate 40 is preferably bent so that the sloped half thereof may closely fixed to the sloped surface of the elongated thin plate for instance by welding. Of course it is possible to form said heater element by punching without using the separate connector piece 40.

It is possible to mount the elongated thin plate 30 between the adjacent two cup insulators 20 of two rows by engaging the side edges of said elongated plate with the annular grooves 24 of the insulators and then fixing said transverse connector thin plates 40.

It is also possible to mount a heater unit formed in one piece of previously welding the transverse thin plates to the longitudinal thin plates by placing the former on the latter and pushing yieldable edge portion of the longitudinal thin plate 30 into the annular groove 24 of the concerned cup insulator 20.

A pair of terminals 50, 50, each of which comprises a screwed bolt 51, an insulating sleeve 52 surrounding said bolt 51 at the middle portion, an upper nut 53 and lower nuts 54, are arranged at opposite corners of the plates 11, 13 and mounted by inserting said screwed bolt into through hole formed in said both plates. Each of the free ends of the heater element is formed with a slit 20 as to engage with said bolt 51 and electrically connected therewith by treadedly tightening said nut 52. Between the lower nuts 54, 54 a lead wire from the electric source not shown is electrically engaged.

It is preferable to provide a bar 55 downwardly protruded from the table plate 20 for readily mounting the heater to a machine frame not shown.

A sensor or thermocouple 61 detecting the temperature of the heater element is arranged preferably at the center of the heater device and fixed directly to the heater element. Said sensor 61 has a lead 62 connected therewith so as to send electrical signal representing the temperature to a temperature controller not shown.

Figure 4A:
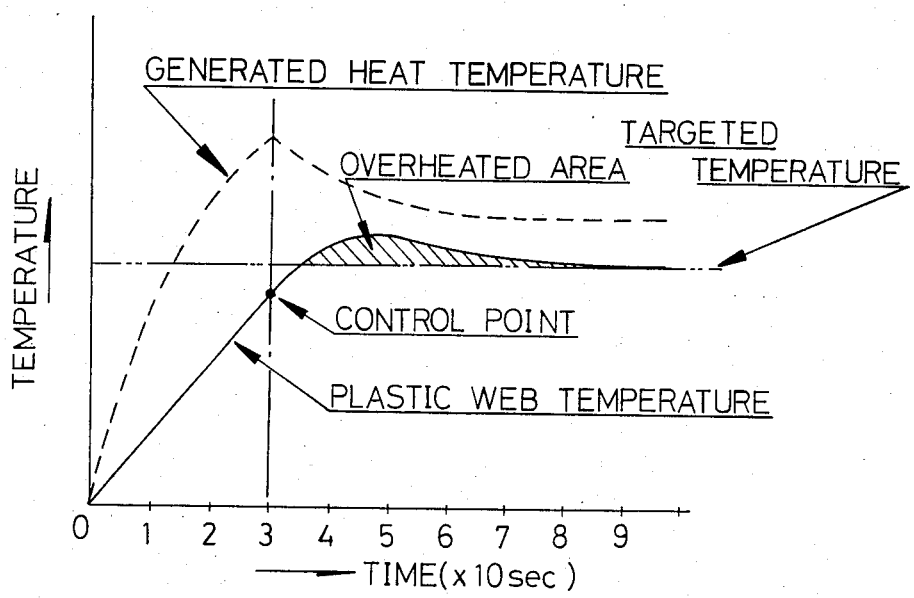
FIG. 4A is a coordinate, in which the temperature and the time are taken respectively in the ordinate and the abscissa, showing temperature changes with the time passage of the conventional heater and of the plastic sheet heated thereby.

In FIG. 4A, changes of temperatures of the quarts tube heater as referred to in the beginning of the specification as typical heater for the forming machine and of the plastic web heated thereby in course of time during which said heater was controlled so as to prevent the overheating are shown by curves respectively in dotted and solid lines. The two dot phantom line represents targeted temperature of the plastic web to be heated.

Three tubes of 12 mm diameter and 500 mm length were arranged side by side with leving a space of a few decade mm between the adjacent two and energized with applying voltage of 200 V.

Due to the quartz tube absorbing heat, the phantom curve rising up to the point (30 seconds) where the heater is to be controlled in reply to the signal of temperature detected by the sensor is slack and the phantom curve slowly falls down due to the absorbed heat of the tube, as a result of which the solid curve representing the plastic sheet temperature does not fall down so soon so that there is inevitably caused a hatched overheated area beyond the targeted temperature line. When the heater is controlled earlier than that, the plastic web can not be sufficiently softened. In either case satisfactory molding formation can not be attained.

Figure 4B:
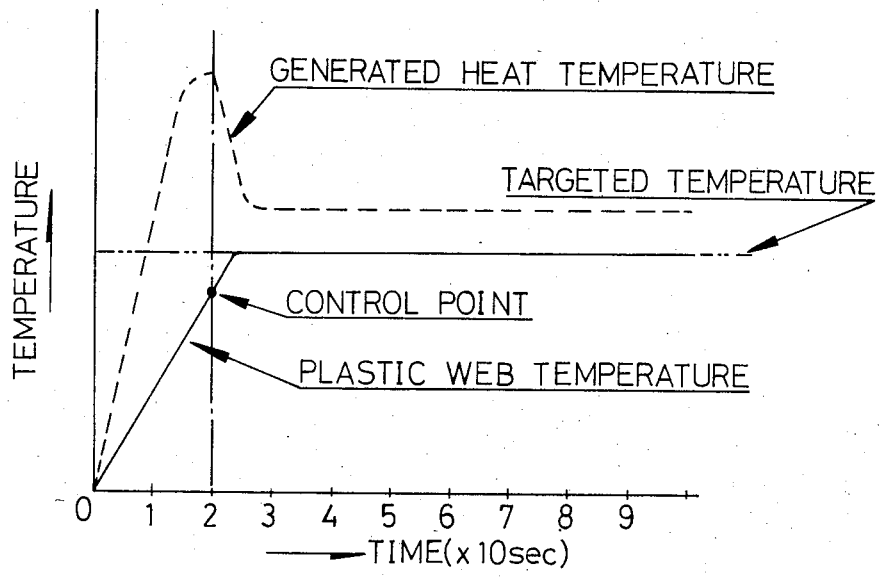
FIG. 4B is a similar coordinate but regarding the heater according to the invention.

In contrast with the above, when using the four heater units each as illustrated in the drawings and of 122 mm × 122 mm, which were so arranged as to form a regular square and applied with voltage of 21 V in view of the safety, as shown in FIG. 4B the temperature of the heater and consequently of the unit plastic web rises up sooner and more sharply so that said heater could be controlled 20 seconds after the energization thereof and the solid line representing the temperature of the heated plastic web may be kept in compliance with the targeted temperature line.

What is claimed is;

1. A radiant heater comprising a table plate; an electrically insulating plate extending over the surface of one side of said table plate; a plurality of elongated thin plates made of a material generating Joule's heat, each of which is longitudinally bent so that the transverse section thereof is substantially V-shaped and longitudinally extended above said insulating plate, being transversely arranged with leaving a space between every adjacent two, which are electrically connected by a transversely extending thin plate of the same material at the free ends thereof so as to form a heater element extended in zig-zag; and a plurality of cup insulators, each of which has a body portion, leg portion protruding to pass through said insulating plate and table plate to be fixed thereto and a head portion forming an annular grooved between the same and said body portion, being transversely arranged in two rows providing suich a space between adjacent two that said longitudinally extended thin plate may be held at the side edges thereof with said annular groove of each of adjacent cup insulators respectively of the two rows.

2. The radiant heater as claimed in claim 1, in which said Joule's heat generating material is a nickel alloy comprising chromium.

3. The radiant heater as claimed in claim 1, in which said heater element is extended in zig-zag from a point in the vicinity of one corner of said rectangular plate to another point in the vicinity of opposite corner and two terminals are mounted respectively at said points so that two ends of said zig-zag heater element are respectively electrically connected with said terminals.

4. The radiant heater as claimed in claim 1, in which a bar is mounted on said table plate at the reverse side thereof for ready attachment.

* * * * *